US005949446A

United States Patent [19]

Lee

[11] Patent Number: 5,949,446

[45] Date of Patent: Sep. 7, 1999

[54] TECHNIQUE FOR ADJUSTING THE TIME FOR DRIVING A PRINT HEAD ACCORDING TO THE CHARACTERISTICS OF THE PRINT PAPERS

[75] Inventor: Jae-Han Lee, Kyonggi-do, Rep. of Korea

[73] Assignee: SamSung Electronics Co., Ltd., Suwon, Rep. of Korea

[21] Appl. No.: 08/818,286

[22] Filed: Mar. 17, 1997

[30] Foreign Application Priority Data

Mar. 15, 1996 [KR] Rep. of Korea ..... 96-6942

[51] Int. Cl.[6] ..... B41J 2/05

[52] U.S. Cl. ..... 347/14; 347/16; 347/57

[58] Field of Search ..... 347/14, 16, 57, 347/193

[56] References Cited

U.S. PATENT DOCUMENTS

| | | | |
|---|---|---|---|
| 4,345,262 | 8/1982 | Shirato | 347/57 X |
| 4,617,580 | 10/1986 | Miyakawa | 347/14 X |
| 4,639,746 | 1/1987 | Yamamoto | 347/5 |
| 4,795,999 | 1/1989 | Takahashi | 347/193 |
| 4,847,638 | 7/1989 | Moriyama | 347/14 |
| 4,983,994 | 1/1991 | Mori | 347/16 X |
| 5,056,042 | 10/1991 | Lieb | 347/144 |
| 5,432,533 | 7/1995 | Shibamiya | 347/192 |
| 5,473,351 | 12/1995 | Helterline | 347/16 X |
| 5,504,506 | 4/1996 | Noaki | 347/16 |
| 5,757,393 | 5/1998 | Suzuki | 347/16 |

FOREIGN PATENT DOCUMENTS

| | | | |
|---|---|---|---|
| 3-213348 | 9/1991 | Japan | B41J 2/12 |

*Primary Examiner*—Joseph Hartary
*Attorney, Agent, or Firm*—Robert E. Bushnell. Esq.

[57] ABSTRACT

A technique for resetting the time for driving a print head of an ink-jet printer, based on different absorptivities of papers to be printed by the ink-jet printer, optimizes the amount of ink emerging from nozzles of the head resulting in a high print resolution. The technique includes: displaying different paper types on a display; selecting one type of paper out of the displayed paper types; obtaining a head driving time corresponding to the selected paper type from a look-up table prestored in a memory device and changing the pre-designated head driving time to the obtained head driving time; and printing data with the changed head driving time.

2 Claims, 7 Drawing Sheets

250

| 1 | 2 | 3 |
|---|---|---|
| 1 | A type | aμs |
| 2 | B type | bμs |
| 3 | C type | cμs |
| 4 | D type | dμs |
| 5 | E type | eμs |
| ⋮ | ⋮ | ⋮ |
| N | N type | nμs |

250

| 1 | 2 | 3 |
|---|---|---|
| 1 | A type | aμs |
| 2 | B type | bμs |
| 3 | C type | cμs |
| 4 | D type | dμs |
| 5 | E type | eμs |
| ⋮ | ⋮ | ⋮ |
| N | N type | nμs |

FIG. 6

TECHNIQUE FOR ADJUSTING THE TIME FOR DRIVING A PRINT HEAD ACCORDING TO THE CHARACTERISTICS OF THE PRINT PAPERS

CLAIM OF PRIORITY

This application makes reference to, incorporates the same herein, and claims all benefits accruing under 35 U.S.C. §119 from an application entitled METHOD AND DEVICE FOR ADJUSTING THE TIME FOR DRIVING A PRINT HEAD ACCORDING TO THE CHARACTERISTICS OF PAPERS earlier filed in the Korean Industrial Property Office on Mar. 15, 1996, and there duly assigned Ser. No. 96-6942 by that Office.

BACKGROUND OF THE INVENTION

1. Field of the Invention

The present invention relates to a technique for adjusting the time for driving a print head according to the characteristics of the print paper. More specifically, the invention relates to a technique for adjusting the time for driving a print head based on different absorptivity of print papers used in an ink-jet printer, so that the amount of ink emerging from the nozzles of the head can be optimally controlled. This results in a high print resolution.

2. Description of the Related Art

As is well known, an ink-jet printer performs a printing job by accelerating and directing ink through nozzles thereof. Responsive to head drive pulses having a 2–3 $\mu$s pulse width, the ink-jet printer heats the ink. When heated, the ink generates bubbles in it. The bubbles cause the ink to emerge from the nozzles to form characters on the print paper.

The nozzles are stopped from moving for an extremely small amount of time, so called the head driving time, to enable the nozzles to spray the ink on the paper. The head driving time is designated based on the characteristics of the ink in the cartridge of the printer. A monochrome ink cartridge and a color ink cartridge that are generally used in an ink-jet printer have a unique head driving time for each.

For example, the monochrome ink cartridge has a head driving time of 3.5 $\mu$s. The color ink cartridge has a head driving time of approximately 2.5 $\mu$s, which is little shorter than the head driving time for the monochrome ink cartridge.

In earlier ink jet printers, a plurality of drive transistors in a head driver respectively drive a plurality of heating elements, each heating element corresponding to one nozzle in the printer head. Power is supplied to a single heating element and as a result, ink is sprayed out of the corresponding nozzle.

The time for driving a head is determined by the width of the head driving pulse. Such a head driving apparatus capable of changing the width of the head driving pulse includes a head driver, a heating portion, and a pulse width changing portion for changing the head driving time.

The pulse width changing portion includes a head driving time setter and a pulse generator. The head driving time setter sets the time for driving the nozzles according to the change in power for driving the head. The pulse generator outputs head driving pulses of uniform width with the time set by the head driving time setter. In addition, a controller is electrically connected to and supplies control signals for changing the width of the head driving pulse to the head driving time setter.

The head driving time determines the amount of ink sprayed from the nozzle to the paper. The absorption of the paper depends on the amount of the sprayed ink, the weight per unit area of the paper, the quality of the paper, and the surface of the paper. Such an absorptivity of the paper affects the print resolution on the paper.

If the amount of ink sprayed does not exceed the absorptivity of the paper, there is no surplus ink that may be sprayed on the paper. On the other hand, if the amount of ink spread on the paper is excessive, with respect to the absorptivity of the paper, surplus ink spreads on the paper and causes a deterioration in the print resolution.

Since the amount of ink sprayed by the head is dependent upon the head driving time, a unique head driving time should be determined based on the consideration of the kind of ink jet printer and the absorptivity of the paper.

However, earlier ink jet printers have a head driving time determined without any consideration of the absorptivity of the paper. In the event that the head driving time is excessive with respect to the characteristics of the paper, an excess amount of the ink is sprayed on the paper, thereby causing a deterioration in the print resolution.

The Miyakawa patent, U.S. Pat. No. 4,617,580, entitled *Apparatus For Recording On Different Types Of Mediums*, discloses an apparatus which controls the density of the image recorded by the ink jet printing unit in accordance with a determination as to the choice of recording medium.

The Moriyama patent, U.S. Pat. No. 4,847,638, entitled *Recorder*, discloses a recording apparatus which adjusts the discharge timing of the ink from a print head in accordance with the thickness of the recording medium.

The Noaki patent, U.S. Pat. No. 5,504,506, entitled *Information Recording Method Capable Of Performing A High Quality Recording In Accordance With Printing Conditions*, discloses an image recording technique which varies the recording in accordance with the recording medium used.

Lastly, the Shibamiya patent, U.S. Pat. No. 5,432,533, entitled *Recording Method With Control of Head Energization And Recording Medium Conveyance Power Consumption*, discloses a recording technique in which the density is varied in accordance with the resultant image on different recording mediums.

While each of the afore-cited patents disclose features in common with the present invention, none of these patents teaches or suggests adjusting the driving time of the print head according to the characteristics of the recording paper as in the present invention.

SUMMARY OF THE INVENTION

It is therefore an object of the present invention to provide a technique for adjusting the head driving time based on the different characteristics of the print paper, i.e., the weight per the unit area ($m^2/g$) of the paper, the quality of the paper, and the surface of the paper, and so on.

To achieve the above and other objects of the invention, the technique includes displaying papers according to the quality thereof; selecting a kind of paper out of the displayed papers; obtaining a head driving time corresponding to the kind of selected paper from a time look-up table of a memory device and changing a preset head driving time to the obtained head driving time; and performing printing with the changed head driving time.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 6 is a look-up table showing the head driving times for different papers.

DETAILED DESCRIPTION OF THE PREFERRED EMBODIMENTS

The time setting device according to the present invention, as well as a preferred mode of use, will be hereinafter described in detail, referring to the accompanying drawings.

Figure 1:
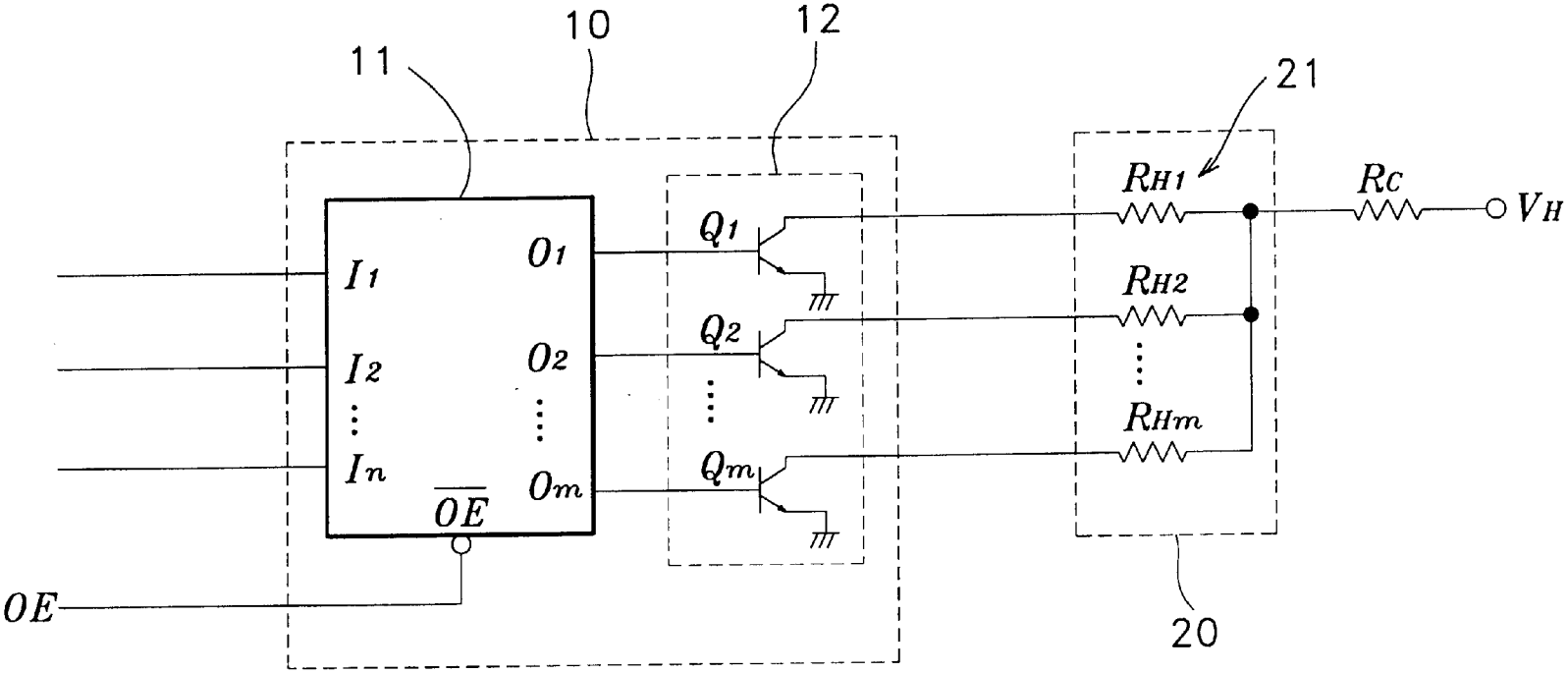
FIG. 1 is a circuit diagram of a head driving device of an earlier ink-jet printer.

The circuit of a head driving device in the ink-jet printer will be described below with reference to FIG. 1. A head driver 10 includes an n×m decoder 11 and a number of driver transistors $Q_1, Q_2, \ldots Q_m$ 12. A number of input terminals $I_1, I_2, \ldots I_n$ and output terminals $Q_1, Q_2, \ldots Q_m$ are included in the n×m decoder 11. The number of the output terminals $Q_1, Q_2, \ldots Q_m$ relative to the number of the input terminals $I_1, I_2, \ldots I_n$ can be represented as $2^n$. When combined signals are inputted into the input terminals $I_1, I_2, \ldots I_n$, the n×m decoder 11 generates a single output through an output terminal corresponding to the combined signals. Each drive transistor $Q_1, Q_2, \ldots Q_m$ is electronically connected to a heating element 21 in the nozzle and turned on/off depending on the control of the n×m decoder 11. The portion 20 composed of the heating elements 21 is coupled to a power supply $V_H$ and supplied with power for driving the heating elements 21.

Figure 2:
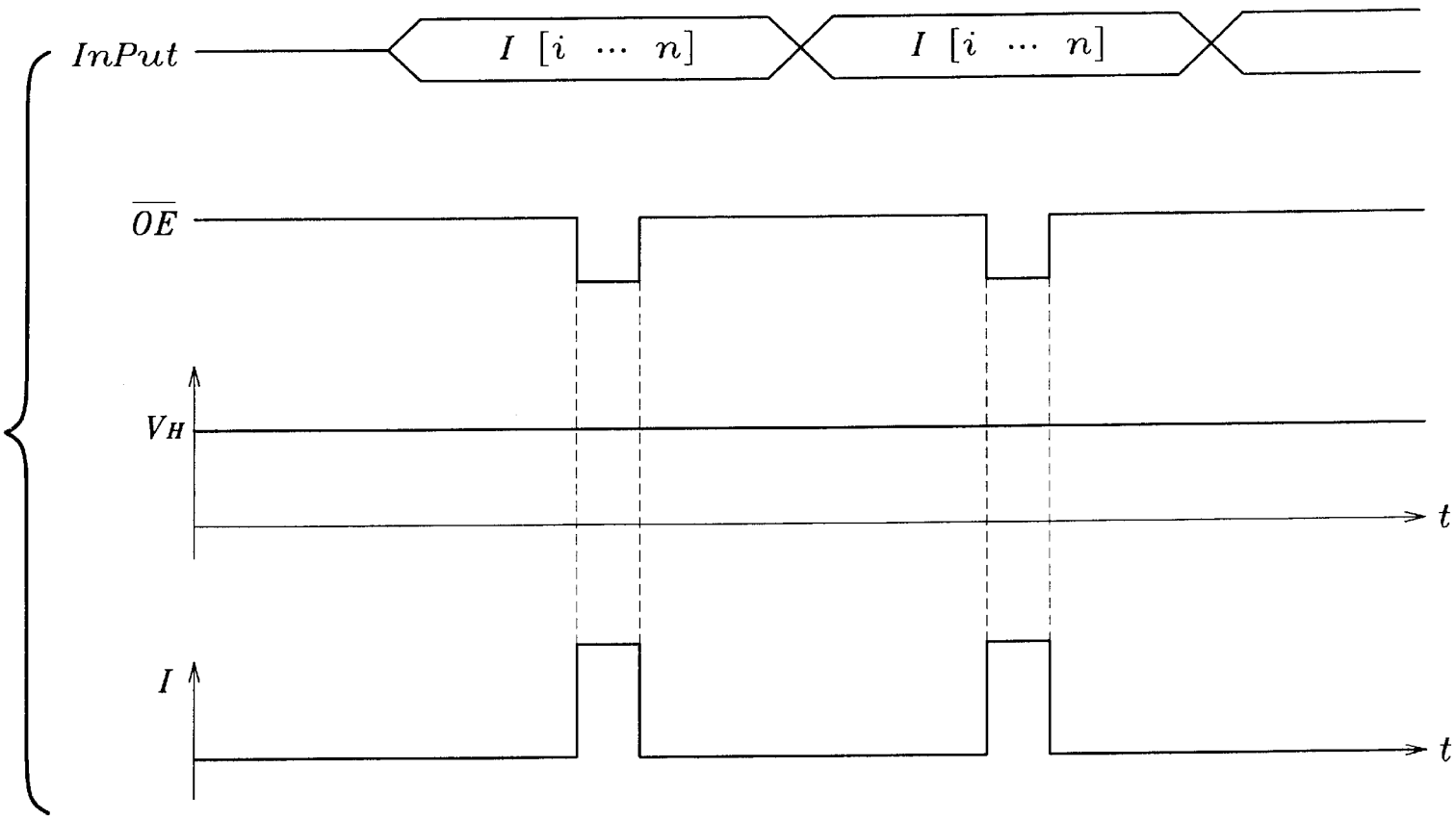
FIG. 2 is a timing chart of the head driving device of FIG. 1.

FIG. 2 is a timing chart for explaining the operation of the head driver. First, an input terminal of the decoder 11 is supplied with an input address I [I] corresponding to the input terminal so that the decoder 11 is made active. One output terminal $Q_1$ is selected out of the plurality of output terminals of the decoder 11 and a driver transistor $Q_1$ is turned on. Power is supplied to a heating element $R_{HI}$ of the portion 20. As a result, ink is sprayed out of the nozzle.

The amount of ink to be sprayed is determined by the energy supplied to the heating element 21. The energy can be represented with the following formula.

$$E=I^2Rt \qquad \text{[Formula 1]}$$

E is an energy supplied to the heating element. I is a current flow through the heating element. R is a resistance of the heating element. t is the time that current flows.

Figure 3:
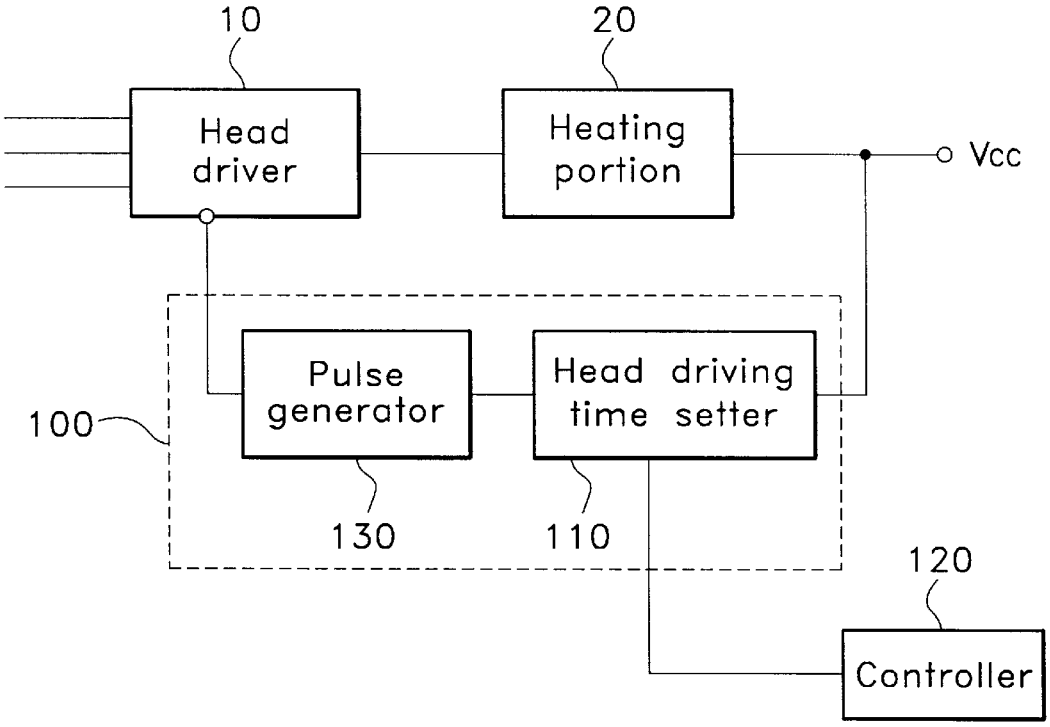
FIG. 3 is a block diagram showing a head driving device of an ink-jet printer whose head driving pulses have variable width.

The time for driving a head is determined by the width of a head driving pulse. A head driving apparatus that is capable of changing the width of a head driving pulse is shown in FIG. 3. The head driving apparatus includes a head driver 10, a heating portion 20 and a pulse width changing portion 100 for changing the head driving time.

The pulse width changing portion 100 includes a head driving time setter 110 and a pulse generator 130. The head driving time setter 110 sets time for driving the nozzles according to the change in power for driving the head. The pulse generator 130 outputs head driving pulses of uniform width with the time set by the head driving setter 110. Moreover, a controller 120 is electrically connected to and supplies control signals for changing the width of the head driving pulse to the head driving setter 110.

As described above, the head driving time determines the amount of ink sprayed from the nozzle to a paper. The absorption of the paper depends on the amount of the sprayed ink, the weight per the unit area ($m^2/g$) of the paper, the quality of the paper, and the surface of the paper. Such an absorptivity of the paper affects the print resolution on the paper.

Figure 4A:
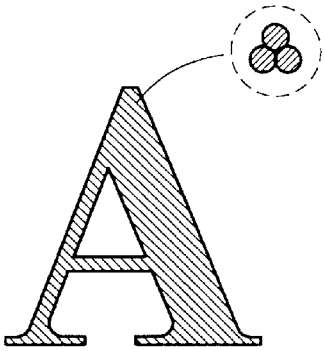
FIG. 4A and FIG. 4B are illustrations showing the relationship between the amount of ink sprayed on a paper and the absorptivity of the paper.
Figure 4B:
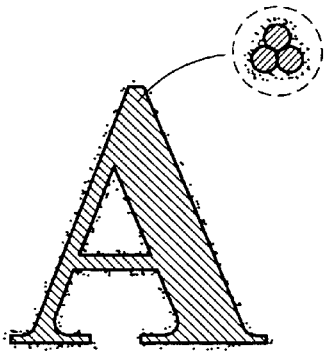

FIG. 4A and FIG. 4B show the relationship between the amount of the sprayed ink and the absorptivity of the paper. The drawings illustrate the result when printing is performed on the same paper with different head driving times. Since the head driving time was usually preset in earlier ink-jet printers, manufacturers inform the users as to which papers have the highest resolution under specific conditions.

Referring to FIG. 4A, a letter A is printed on a paper by an ink-jet printer whose head driving time is predesignated as 2.0 μs and which forms characters on a paper in such a way that ink spurts dots on the paper through the nozzle. The dot-spurted ink is absorbed in the paper. A portion of the printed letter A is enlarged to show the print resolution.

The amount of the ink sprayed with a 2.0 μs head driving time does not exceed the absorptivity of the paper. Therefore, there is no surplus ink that may be spread on the paper.

FIG. 4B shows a letter A printed on the same paper as in FIG. 4A. The head driving time of the ink-jet printer is designated as 3.0 μs in this embodiment. A portion of the printed letter A is also enlarged to show the resolution. More ink is sprayed when the head driving time is 3.0 μs than when it is 2.0 μs.

At this time, the amount of the ink sprayed with 3.0 μs head driving time exceeds the absorptivity of the paper. As a result, the surplus ink spreads on the paper as shown in FIG. 4B.

Therefore, a unique head driving time should be determined based on the consideration of the kind of ink-jet printer and the absorptivity of the paper.

However, the earlier ink-jet printer has a head driving time determined without any consideration of the absorptivity of the paper. I the event that the head driving time is not appropriate for the characteristics of the paper, an improper amount of ink is sprayed on the paper. The improper excess amount of ink runs over the paper, which causes a deterioration of the print resolution.

Figure 5:
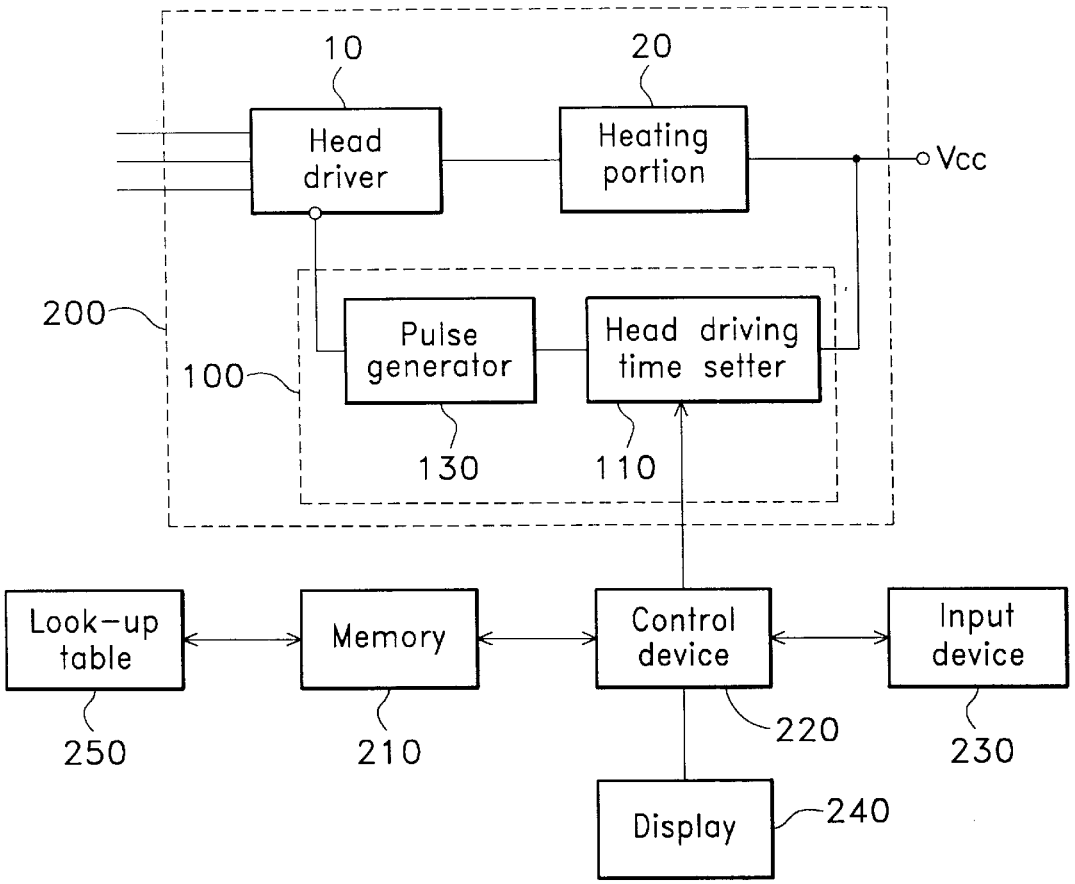
FIG. 5 is a block diagram showing a time setting device according to the present invention, which sets the time for driving a print head, based on the characteristics of the paper.

Referring to FIG. 5, the time setting device includes a control device 220, e.g. a microprocessor for controlling other components. An input device 230 is coupled to the control device 220 and generates signals when operated by a user. The input device 230 may be a keyboard, a mouse and a keypad, and so on. The signals generated in the input device 230 are inputted into and processed in the control device 220 to output control signals. A display 240, e.g. a monitor and an LCD(Liquid Crystal Display) are also provided for visibly displaying information. The information is generated by the control signals from the control device 220. The time setting device further includes an internal or external memory 210 and a head driving unit 200, which are also coupled to the control device 220. The control device 220 calls data from the memory 210. Ink spurts form dots on a paper with the head driving time adjusted by the control device 220.

The head driving unit 200 includes: a pulse width changing portion 100 for generating head driving pulses to change the width of the pulses; a head driver 10 for receiving the changed pulses from the pulse width changing portion 100 and generating signals for driving a nozzle; and a heating portion 20 for spraying ink responsive to the nozzle driving signals.

Moreover, also stored in the memory 210 are a printer driver(not shown) which is software for allowing a computer and a printer to communicate with each other, and a look-up table 250 that is software having different head driving times assigned for each kind of paper. For description purposes, the look-up table 250 is seen as a block in the drawing.

The look-up table 250 is semi-permanent information. As shown in FIG. 6, the first column of the table has address codes that allow the control device 220 to recognize the kinds of the papers and the optimum head driving times for the papers. The second column of the table indicates the kinds of the papers, which are classified by several factors, e.g. the weight per the unit area ($m^2/g$) of the paper, the thickness of the paper, and the surface of the paper, and so on. The third column of the table indicates optimum head driving times for the papers. The look-up table 250 is preferably stored in a ROM(Read Only Memory) which stores data in permanent form or in an HDD(Hard Disk Drive) which is an external memory.

When it receives a print command from a user, the control device 220 displays the paper type via the display 240 with reference to the first column of the table 250, i.e. the address codes and waits until the user selects the kind of paper to be printed.

Afterwards, when the user selects a paper type corresponding to the paper to be printed, the control device 220 obtains an optimum head driving time for the paper from the look-up table 250 with reference to the address codes of the papers, followed by the generation of the control signals corresponding to the obtained head driving time. Responsive to the control signals, the head driving time setter 110 of the pulse width changing portion 100 of the head driving unit 200 sets the head driving time. Finally, the control device 220 controls the pulse generator to change the width of the pulses based on the set head driving time. In this way, the head driving time can be adjusted according to the selected paper.

Figure 7:
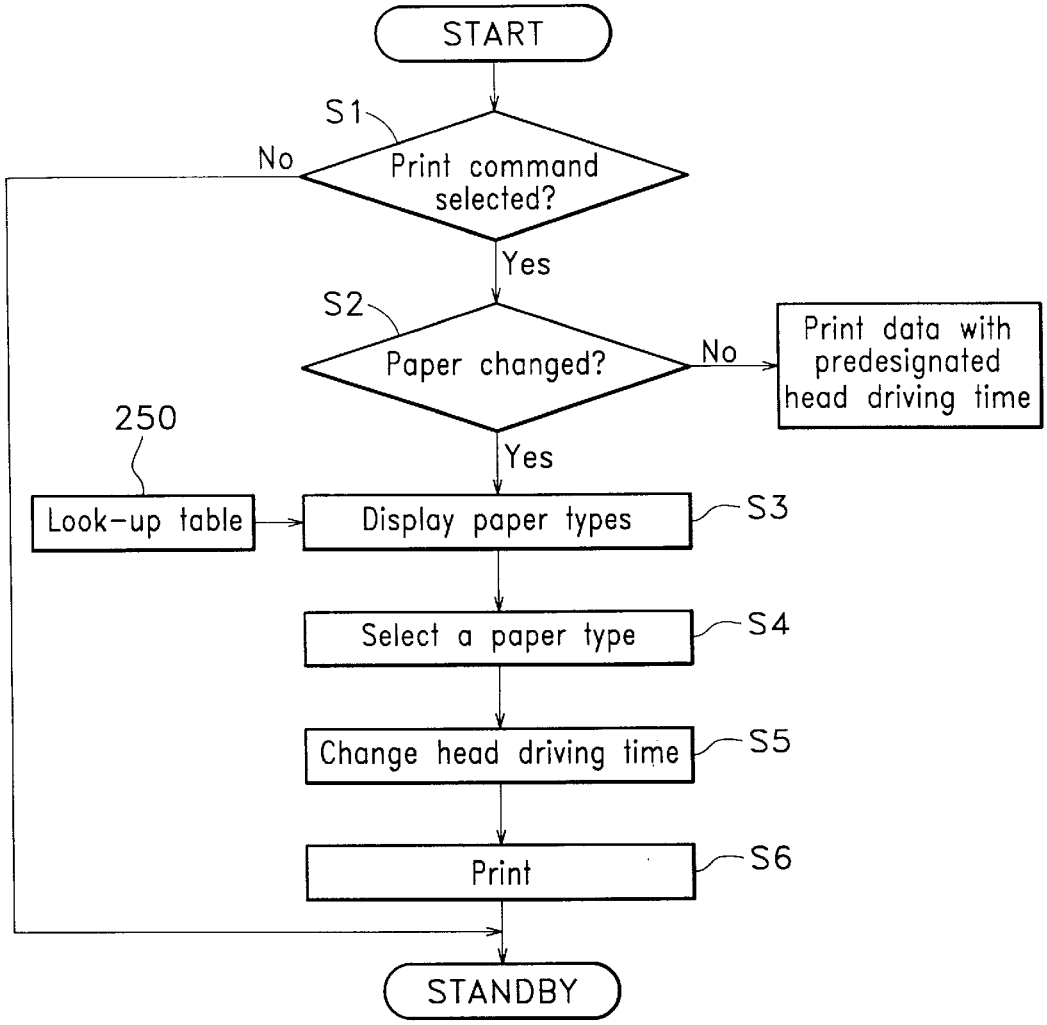
FIG. 7 is a flowchart showing the method of setting the head driving time.

The flowchart of FIG. 7 illustrates the process of the adjustment of the head driving time. When supplied with power, the ink-jet printer initiates its operation and stands by for a print command.

At step S1, a determination is made as to whether or not the print command has been supplied.

If it has been determined that the print command has been supplied, the printer receives data to be printed from a computer via a cable that interconnects the printer and the computer. Afterwards, a determination is made as to whether or not the user has inputted any change in the print paper into the printer at step S2.

If it has been determined at step S1 that the print command has not been supplied, the printer returns to the standby status.

If it has been determined that the user has inputted a change in the print paper at step S2, the printer obtains data on the various kinds of papers from the look-up table 250 that is prestored in the memory 210 and displays various paper types on the display 240 at step S3.

Otherwise, if it has been determined that the user has not inputted any change in the print paper, the printer assumes the same print paper has been supplied and performs the printing job with the previously designated head driving time.

At step S4, the user selects a paper from the various paper types shown on the display 240. When the paper type has been selected, the control device 220 obtains a head driving time corresponding to the selected paper type from the look-up table 250. Then, in step S5, the control device 220 then changes the width of the head driving pulses in the pulse width changing portion 100 of the head driving unit 200 in response thereto. Afterwards, the changed head driving pulses are inputted into the head driver 10 and ink spurts form dots to print the data from the computer on the paper using the changed head driving pulses at step S6. Upon completion of the printing job, the printer stands by for the following print command.

In the event that the user does not select a paper type in a predetermined time, the printer performs the printing job with the predesignated head driving time.

As described above, it is possible to achieve the optimum print resolution on the print paper by adjusting the width of the head driving pulses and thereby controlling the amount of the ink sprayed on the paper.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A method of adjusting the time for driving a print head of an ink-jet printer, according to the type of paper to be printed by the ink-jet printer having a predesignated head driving time, comprising the steps of:

storing a plurality of different paper types in a memory device;

determining if a printing command signal has been inputted to a controller of the printer;

retrieving and displaying said plurality of different paper types on a display;

selecting one type of paper out of the plurality of displayed paper types;

obtaining a head driving time corresponding to the selected paper type from a look-up table prestored in said memory device and changing the predesignated head driving time to the obtained head driving time; and printing on the paper using the changed head driving time;

wherein the obtaining step further includes the steps of:

recognizing an address code stored in said memory device and corresponding to the selected paper type; and obtaining a head driving time stored in said memory device and corresponding to the address code.

2. A device for setting a time for driving a print head of an ink-jet printer, according to the type of paper to be printed by the ink-jet printer having a predesignated head driving time, comprising:

a memory for storing a look-up table which contains a plurality of different paper types and different head driving times corresponding to each of the paper types;

a selector for selecting a paper type;

a controller for obtaining from the memory a head driving time corresponding to said selected paper type from said selector;

a time changer for changing the predesignated head driving time to the obtained head driving time received from the controller; and a head driver connected to the print head for driving the print head using the changed head driving time received from the controller;

wherein said memory storing the look-up table includes:

a paper type portion for storing information of a plurality of paper types which are classified according to the quality thereof;

a head driving time portion for storing respective different head driving times for each of the plurality of paper types; and an address code portion for storing address codes which allow the controller to recognize the selected type of paper and the optimum head driving time for the paper.

* * * * *